US008529234B2

(12) United States Patent
Yoshimura et al.

(10) Patent No.: US 8,529,234 B2
(45) **Date of Patent: *Sep. 10, 2013**

(54) WATER INJECTION TYPE SCREW FLUID MACHINE

(75) Inventors: Shoji Yoshimura, Takasago (JP); Toru Noguchi, Kako-gun (JP)

(73) Assignee: Kobe Steel, Ltd., Kobe-shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/302,061

(22) Filed: Nov. 22, 2011

(65) Prior Publication Data

US 2012/0164015 A1 Jun. 28, 2012

(30) Foreign Application Priority Data

Dec. 27, 2010 (JP) ..... 2010-290058
Mar. 10, 2011 (JP) ..... 2011-052868

(51) Int. Cl.

| | |
|---|---|
| ***F03C 2/00*** | (2006.01) |
| ***F03C 4/00*** | (2006.01) |
| ***F04C 15/00*** | (2006.01) |
| ***F04C 2/00*** | (2006.01) |

(52) U.S. Cl.

USPC ..... 418/98; 418/201.1; 418/102; 418/104; 418/141; 418/270; 277/351; 277/303

(58) Field of Classification Search

USPC ..... 418/98, 101, 102, 104, 140, 141, 418/201.1, 206.1–206.8, 270; 277/351, 303, 277/412, 562

See application file for complete search history.

(56) References Cited

U.S. PATENT DOCUMENTS

| | | | | |
|---|---|---|---|---|
| 3,556,697 | A * | 1/1971 | Webb et al. | 418/98 |
| 3,975,123 | A * | 8/1976 | Schibbye | 418/102 |
| 5,641,280 | A * | 6/1997 | Timuska | 418/102 |
| 6,095,780 | A * | 8/2000 | Ernens | 418/104 |
| 6,174,148 | B1 | 1/2001 | Suzuki | |
| 6,287,100 | B1 * | 9/2001 | Achtelik et al. | 418/104 |
| 7,713,040 | B2 * | 5/2010 | Kimura et al. | 418/104 |
| 8,007,263 | B2 | 8/2011 | Yoshimura et al. | |
| 2012/0230857 | A1 * | 9/2012 | Noguchi | 418/201.1 |

FOREIGN PATENT DOCUMENTS

| | | | |
|---|---|---|---|
| JP | 07317553 | A * | 12/1995 |
| JP | 2000-45948 | | 2/2000 |
| JP | 2007132243 | A * | 5/2007 |
| JP | 4559343 | | 7/2010 |

OTHER PUBLICATIONS

U.S. Appl. No. 13/398,097, filed Feb. 16, 2012, Noguchi.

* cited by examiner

*Primary Examiner* — Theresa Trieu
(74) *Attorney, Agent, or Firm* — Oblon, Spivak, McClelland, Maier & Neustadt, L.L.P.

(57) ABSTRACT

A water-lubrication type screw fluid machine has a first non-contact seal, a second non-contact seal and a lip seal disposed between a rotor chamber and a bearing for a rotor shaft. The bearing is located on the high pressure side and in this order from the rotor chamber side. the bearing includes a low pressure communicating channel for allowing an outflow space formed on the rotor chamber side with respect to the first non-contact seal to communicate with a low pressure channel for the target gas communicating with a low pressure space inside the rotor chamber or the rotor chamber, a pressurized communicating channel for introducing high-pressure target gas into a pressurized space formed between the first and second non-contact seals, and an open communicating channel through which an open space formed between the second non-contact seal and the lip seal opens to the outside of the casing.

7 Claims, 5 Drawing Sheets

WATER INJECTION TYPE SCREW FLUID MACHINE

BACKGROUND OF THE INVENTION

1. Field of the Invention

The present invention relates to water injection type screw fluid machines.

2. Description of the Related Art

In a screw fluid machine, such as a screw compressor for compressing a target gas by means of intermeshing male and female screw rotors housed in a rotor chamber, or a screw expander (an expansion apparatus), in which the target gas is expanded to rotate the intermeshing male and female screw rotors in the rotor chamber, a shaft sealing structure is provided between a rotor shaft of the screw rotor and a bearing to seal the target gas in a system or prevent the target gas from being mixed with outside air or the like.

In conventional screw compressors as described in Japan Patent No. 4559343, a lip seal is used as a shaft sealing device on the intake side, while a mechanical seal is used as a shaft sealing device on the discharge side.

Although the lip seal is an inexpensive and space saving shaft sealing device, the maximum pressure which can be sealed by the lip seal is typically around 0.3 kgf/cm$^2$. For this reason, since the lip seal could have an insufficient shaft sealing effect or tend to be significantly inferior in durability when used on the high pressure side, the lip seal can be only used to seat a shaft on the low pressure side. On the other hand, the mechanical seal, which is capable of sealing a shaft under on the high pressure side, is problematic in terms of its extremely high cost and large footprint.

In the screw compressor disclosed in the above noted Japan Patent No. 4559343, the lip seal is used for sealing a shaft on the intake side and also used for sealing the shaft on the discharge side. In order to prevent application of an excessive pressure on the lip seal, which is used for sealing the shaft on the discharge side, the screw compressor is equipped with a labyrinth seal disposed between a screw rotor and the lip seal, and a communicating channel for allowing a space between the labyrinth seal and the lip seal to be communicated with an intake channel or an intermediate pressure section located close to the intake side in the rotor chamber.

On the other hand, as described in JP 2000-45948-A, for example, some screw fluid machines are of a water injection type that water is injected into a rotor chamber for the purposes of lubrication and cooling. When the lip seal is used as the shaft sealing device in such a screw fluid machine of the water injection type, it is necessary for the lip seal to have a water sealing function. However, because lubrication property of water is poor as contrasted to oil, the lip seal becomes more vulnerable to abrasion when it is used for sealing water. Therefore, such a water injection type screw fluid machine suffers from a problem that the lip seal has a short service life, necessitating frequent maintenance.

SUMMARY OF THE INVENTION

In view of the problems set forth above, the present invention advantageously provides a water lubrication type screw fluid machine, in which a shaft sealing device has a long life.

In order to overcome the above problems, a water injection type screw fluid machine according to the present invention, in which a target gas is compressed or expansion force of the target gas is converted into turning force by intermeshing male and female screw rotors housed in a rotor chamber formed in a casing, while water is injected inside the rotor chamber to lubricate the screw rotors, the screw fluid machine comprising: a first non-contact seal, a second non-contact seal, and a lip seal, which are disposed between the rotor chamber and a bearing for a rotor shaft of the screw rotor and in this order from the rotor chamber side; a pressurized communicating channel for introducing the target gas which is at high pressure into a pressurized space formed between the first non-contact seal and the second non-contact seal; and an open communicating channel, through which an open space, which is formed between the second non-contact seal and the lip seal, opens to an outside of the casing.

According to the above-described structure, a pressure of the pressurized space is increased by introducing the target gas whose pressure is increased through the high pressure communicating channel. In this way, because the pressure of the pressurized space is maintained at high pressure, water that leaks out of the rotor chamber into an outflow space is not allowed to flow into the pressurized space. In addition, even if water could leak into the pressurized space and thus the open space, the leaked water is released from the open space through the open communicating channel to the outside, which can prevent the leaked water from arriving at the lip seal without increasing the pressure of a sealed space. As a result, the lip seal is protected against damage, and a leak of a lubricating oil for the bearing caused by the entry of water into the lip seal can be avoided.

Further, the bearing may be a bearing on the high pressure side, and the water injection type screw fluid machine may further include a low pressure communicating channel for allowing an outflow space, which is formed on the rotor chamber side with respect to the first non-contact seal, to be communicated with a low pressure space inside the rotor chamber or a low pressure channel for the target gas, which is in communication with the rotor chamber.

According to the above-described structure, the pressure of the outflow space is reduced by connecting the outflow space through the low pressure communicating channel to the rotor chamber or an intake channel whose pressure is lower than a discharge pressure, while the pressure of the pressurized space is increased by introducing the target gas whose pressure is increased through the pressurized communicating channel. In this way, because the pressure of the pressurized space is maintained at the pressure higher than that of the outflow space, the water leaked out of the rotor chamber into the outflow space is not allowed to flow into the pressurized space, and the water is circulated through the low pressure communicating channel into the rotor chamber. Further, even if the water would be leaked into the pressurized space and thus the open space, the leaked water is released from the open space through the open communicating channel to the outside. In this way, it can be prevented without increasing the pressure of the sealed space that the leaked water arrives at the lip seal. This contributes to remarkably enhanced effects of protecting the lip seal against damage and preventing a leak of the lubricating oil for the bearing resulting from entry of the water into the lip seal.

Still further, the water injection type screw fluid machine of the present invention may be a water injection type screw compressor for compressing the target gas; further include a water recovery unit for separating the water from the target gas that is discharged; and supply the target gas, from which the water is separated in the water recovery unit, through a pressure reducing means to the pressurized communicating channel.

According to the above structure, a part of the target gas discharged from the water injection type screw compressor can be reused as the target gas to be introduced into the pressurized space, which can eliminate the necessity to provide an additionally attached facility for supplying the target gas to the pressurized communicating channel.

Moreover, the water injection type screw fluid machine of the present invention may supply the target gas, from which the water is separated in the water recovery unit, through a dryer to the pressurized communicating channel.

According to the above structure, after the water recovery unit removes water from the target gas to be introduced into the pressurized space, the target gas can be further dehumidified by means of the dryer, to ensure that there is no possibility of supplying water through the pressurized communicating channel to each shaft sealing means.

In addition, in the water injection type screw fluid machine of this invention, an on-off valve, which is closed when operation of the water injection type screw fluid machine is stopped, may be installed in the pressurized communicating channel or in a flow path between the water recovery unit and the pressurized communicating channel.

According to the above structure, when a plurality of the screw fluid machines are connected at their discharge side (at positions in the discharge channels located downstream of the water recovery units) to each other, for example, it can be avoided that the pressurized communicating channel of one of the screw fluid machines which has been stopped is supplied with a part of the target gas discharged from other screw fluid machines in operation. Thus, the target gas can be effectively utilized.

Further, the water injection type screw fluid machine of the present invention may further include a sleeve member fittingly mounted around the rotor shaft, the sleeve member located in the open space and equipped with a flange projected toward a radial outside.

According to the above-described structure (the flange), because water leaked out of the rotor chamber and penetrated into the open space can be dispersed toward the radial outside by centrifugal force created by the flange, and consequently released through the open communicating channel to the outside, a risk of penetration of leaked water into the lip seal can be further reduced.

Still further, in the water injection type screw fluid machine of the present invention, each of the first and second non-contact seals may include: a fit member having opposed surfaces formed so as to be opposed to each other across an interval along an axial direction; two seal rings, which are respectively contacted with the opposed surfaces; and an elastic member disposed between the two seal rings to push the seal rings against the opposed surfaces.

According to this structure, even if the seal ring in the non-contact seal is brought into contact with the rotor shaft, the seal ring can be shifted along a radial direction, to thereby prevent the possibility that the non-contact seal or the rotor would be severely damaged. Therefore, a clearance between the non-contact seal (the seal ring) and the rotor shaft can be reduced to a minimum, which can lead to further improvement in the effect of sealing the shaft. Thus, a risk that the leaked water reaches the lip seal can be reduced.

DESCRIPTION OF THE PREFERRED EMBODIMENTS

Figure 1:
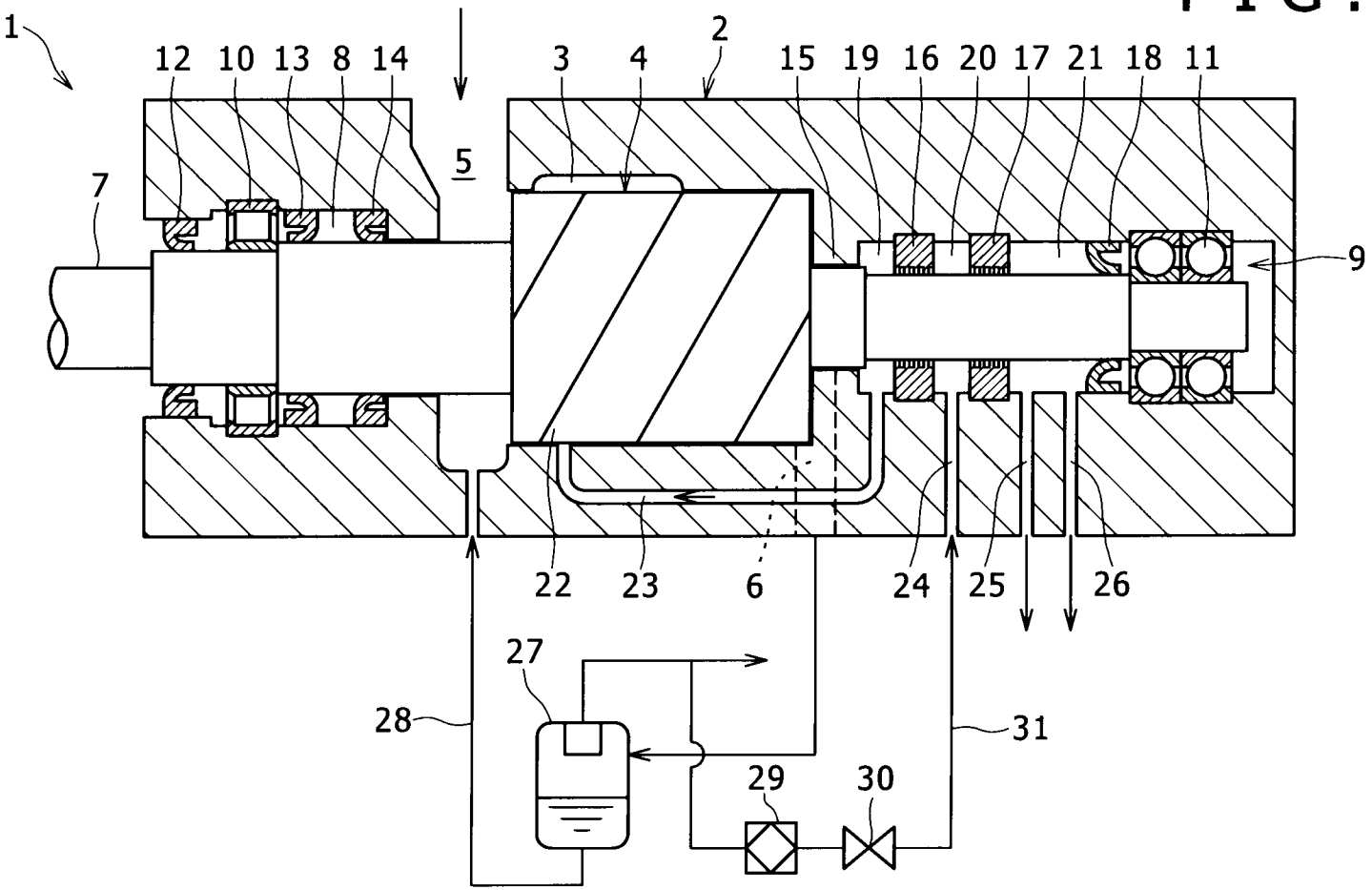
FIG. 1 is a simplified cross sectional diagram of a screw compressor according to a first embodiment of the present invention.

Hereinafter, embodiments of the present invention will be described with reference to the drawings. FIG. 1 schematically shows a water injection type screw compressor 1 which is a first embodiment of a water injection type screw fluid machine according to this invention. The screw compressor 1 functions to discharge a target gas (such as, for example, air) compressed by means of a pair of intermeshing male and female screw rotors 4 housed in a rotor chamber 3, which is formed inside a casing 2. Further, in the screw compressor 1, water is introduced into the rotor chamber 3 for cooling, sealing, and lubrication.

The casing 2 includes an intake channel (a low pressure channel) 5, which is in communication with the rotor chamber 3 to supply the rotor chamber 3 with the target gas to be compressed, a discharge channel 6, which is in communication with the rotor chamber 3 to discharge the target gas compressed in the rotor chamber 3 by the screw rotors 4, and shaft supporting and sealing spaces 8 and 9, which are formed to respectively install structures for supporting and sealing a rotor shaft 7 of the screw rotor 4 on both an intake side and a discharge side.

The rotor shaft 7 is rotatably supported by both a roller bearing 10 installed in the shaft supporting and sealing space 8 on the intake side and two ball bearings 11 installed in the shaft supporting and sealing space 9 on the discharge side, and extended through the shaft supporting and sealing space 8 on the intake side so as to be connected to a motor, which is not illustrated.

In an area on the motor side with respect to the roller bearing 10, a lip seal 12 is installed to block foreign matter (such as a lubricating oil for the roller bearing 10) from penetrating the motor side. On the other hand, in an area on the screw rotor 4 side with respect to the roller bearing 10, a lip seal 13 is installed for sealing the area to block the lubricating oil for the roller bearing 10 from flowing toward a rotor chamber 3 side, while a lip seal 14 is installed for sealing the area to block the target gas or a lubricating fluid from penetrating a roller bearing 10 side from the intake channel 5.

A partitioning wall section 15 defining an end surface of the rotor chamber 3 on the discharge side (a high pressure side) is formed in the casing 2 to separate the rotor chamber 3 from the shaft supporting and sealing space 9 on the discharge side. Between the partitioning wall section 15 and the ball bearings 11 in the shaft supporting and sealing space 9 on the discharge side, a first non-contact seal 16, a second non-contact seal 17, and a lip seal 18 are installed in this order from the rotor chamber 3 side.

The first and second non-contact seals 16 and 17 are commonly known labyrinth seals, in which passage of a fluid is suppressed by creating a small clearance of approximately 0.02 mm around the rotor shaft 7 with the intention of causing a high pressure loss of the fluid that is to pass through the clearance. The lip seal 18 is placed in an orientation in which the lubricating oil for the ball bearings 11 can be prevented from flowing out toward the rotor chamber 3 side.

The first non-contact seal 16, the second non-contact seal 17, and the lip seal 18 divide the shaft supporting and sealing space 9 into respective spaces to create an outflow space 19 between the partitioning wall section 15 and the first non-contact seal 16, a pressurized space 20 between the first non-contact seal 16 and the second non-contact seal 17, and an open space 21 between the second non-contact seal 17 and the lip seal 18.

The casing 2 further includes a low pressure communicating channel 23 for allowing the outflow space 19 to communicate with a low pressure space 22, which is a space, isolated from the intake channel 5 of the rotor chamber 3, in the midstream of compression, a pressurized communicating channel 24 for introducing the target gas at high pressure into the pressurized space 20, and open communicating channels 25, 26 that communicate with the open space 21 and the outside of the casing 2 so that the open space 21 opens to the atmosphere.

In addition, the water injection type screw compressor 1 is further equipped with a water recovery unit 27, which separates water from the target gas discharged from the discharge channel 6, a water supply pipe 28, which re-supplies the water separated and recovered by the water recovery unit 27 into the intake channel 5, and a pressurized pipe 31, which introduces a part of the target gas from which water is removed by the water recovery unit 27 into the pressurized communicating channel 24 through a filter 29 and a regulator 30. The regulator 30 is adjusted to reduce a pressure of the target gas almost to a pressure slightly higher than that of the low pressure space 22. For example, when the pressure of the low pressure space 22 is approximately 0.03 MPa, the pressurized space 20 is adjusted to be almost at a pressure (of 0.13 MPa) which is higher by approximately 0.1 MPa than the pressure of the low pressure space 22. It should be noted that, in addition to the regulator 30, another pressure reducing means, such as, for example, an orifice, may be installed in the pressurized pipe 31 between the regulator 30 and the pressurized space 20.

In the thus-configured water injection type screw compressor 1, because the outflow space 19 is in communication with the low pressure space 22 inside the rotor chamber 3, and the target gas at a pressure higher than that of the low pressure space 22 is introduced into the pressurized space 20, the pressure of the outflow space 19 becomes lower than that of the pressurized space 20. This generates, in the clearance between the first non-contact seal 16 and the rotor shaft 7, a tiny stream of the target gas flowing from the pressurized space 20 to the outflow space 19. Due to the stream, the water discharged from the rotor chamber 3 into the outflow space 19 along with the target gas is prevented from entering the pressurized space 20. In this way, the lip seal 18 can be protected against damage caused by water that reaches the lip seal 18, to thereby block the lubricating oil for the ball bearings 11 from being leaked out.

Meanwhile, the target gas is gradually introduced from the pressurized space 20 through the clearance between the second non-contact seal 17 and the rotor shaft 7 into the open space 21. Because the target gas introduced into the open space 21 is released through the open communicating channels 25 and 26 into the atmosphere, the pressure of the open space 21 is maintained at an atmospheric pressure. Thus, even if water is introduced into the open space 21, for example, while the water injection type screw compressor 1 is stopped, damage which will be inflicted on the lip seal 18 can be kept to a minimum, because the introduced water is released through the open communicating channels 25, 26 into the atmosphere.

Figure 2:
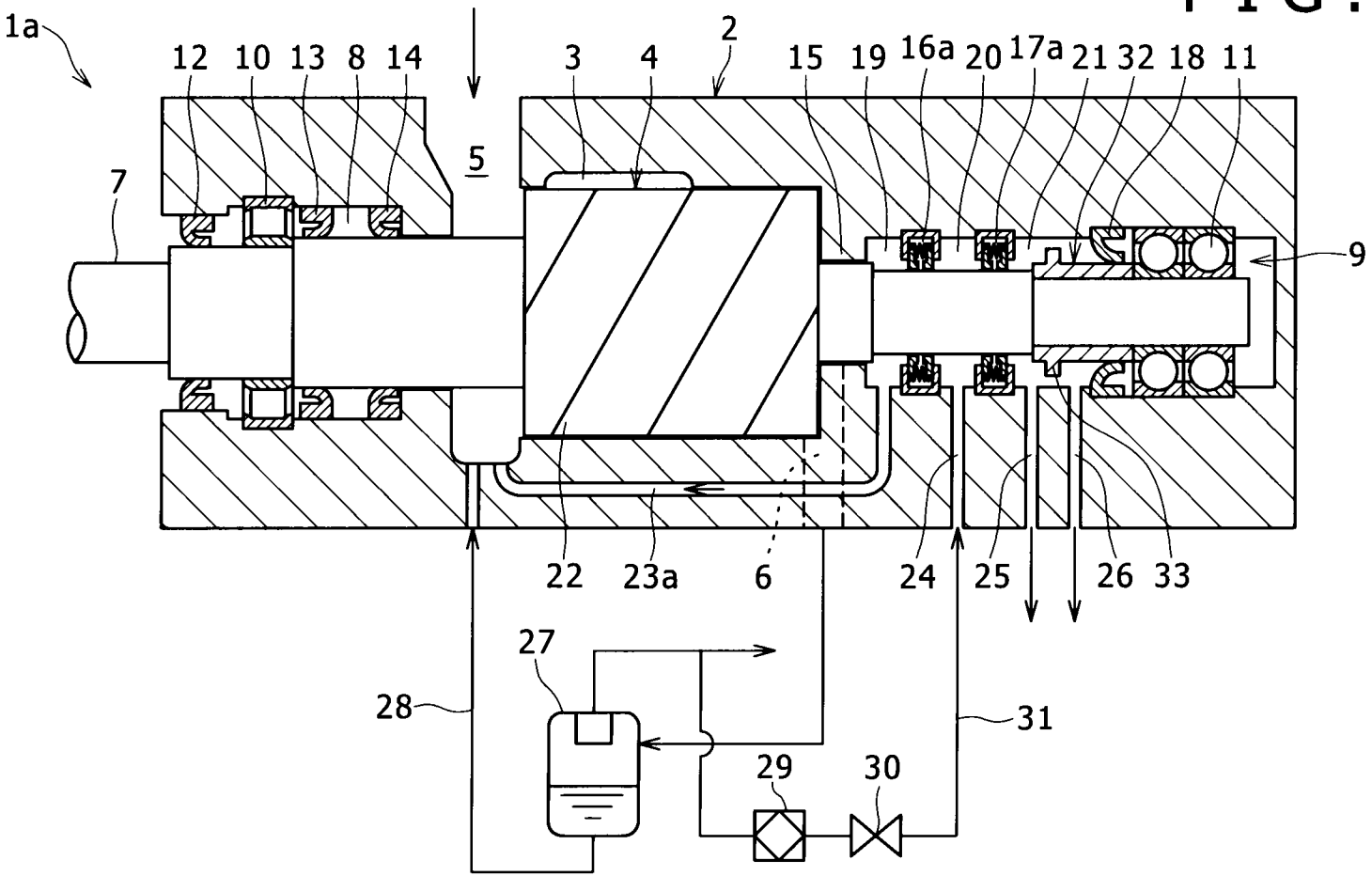
FIG. 2 is a simplified cross sectional diagram of a screw compressor according to a second embodiment of the present invention.

Next, referring to FIG. 2, a water injection type screw compressor la according to a second embodiment of this invention is shown. It should be noted that, in the embodiments described later, the same components as those in the previous embodiment are designated by the same reference numerals as those of the previous embodiment, and the descriptions related to these components will not be repeated.

The water injection type screw compressor 1*a* of this embodiment includes a sleeve member 32, which is fittingly mounted on the rotor shaft 7 while being slidably contacted with the lip seal 18. On the sleeve member 32 extended in the open space 21, a flange 33 is formed so as to be annularly projected toward a radial outside at a location between the open communicating channel 25 and the open communicating channel 26.

Even when water is allowed to enter the open space 21 while flowing on the rotor shaft 7, the flange 33 disperses the water toward the radial outside due to centrifugal force since the sleeve member 32 is rotated together with the rotor shaft 7. In this way, it is ensured that the water is released into the atmosphere through the open communicating channels 25, 26, to thereby prevent the water from reaching the lip seal 18.

Further, in the thus-configured water injection type screw compressor 1*a*, the low pressure communicating channel 23*a* is in communication with the intake channel 5. Therefore, the regulator 30 is adjusted so as to reduce the pressure of the target gas to a pressure slightly higher than the pressure of the intake channel 5. In addition, a first non-contact seal 16*a* and a second non-contact seal 17*a* of this embodiment have a self aligning function.

Figure 3:
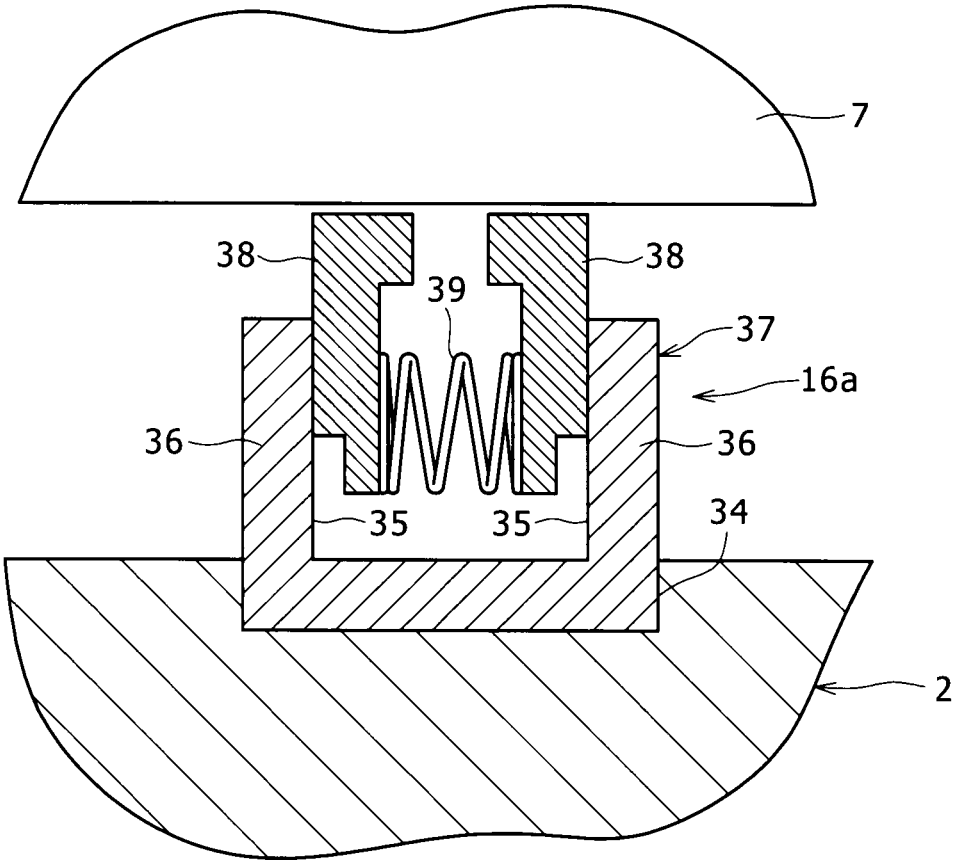
FIG. 3 is an enlarged cross sectional diagram of a first non-contact seal depicted in FIG. 2.

FIG. 3 shows the structure of the first non-contact seal 16*a* of this embodiment in detail. It should be noted that the second non-contact seal 17*a*, which is not shown, has a structure identical to the first non-contact seal 16*a*. The first non-contact seal 16*a* is configured by a fit member 37, which is fitted in a fit groove 34 formed in the casing 2 and equipped with two opposed wall sections 36 defining two axially opposed surfaces 35, two seal rings 38, which are respectively brought into contact with the opposed surfaces 35 and located, at their inner circumferences, close to the rotor shaft 7, and an elastic member 39, which is disposed between the two seal rings 38 to push the sealing rings 38 against the opposed surfaces 35.

Although outer diameters of the seal rings 38 are defined to be smaller than an inner diameter of the fit member 37 in order to make the seal rings 38 radially movable inside the fit member 37, the seal rings 38 are usually maintained at fixed positions due to friction force between the opposed surfaces 35 and the seal rings 38. Upon coming into contact with the rotor shaft 7, however, the seal rings 38 are pushed by the rotor shaft 7 and slidingly moved along a radial direction inside the fit member 37. As a result, the seal rings 38 are self-aligned with respect to the rotor shaft 7.

This self aligning function prevents, even when the first and second non-contact seals 16*a* and 17*a* are brought into contact with the rotor shaft 7 due to vibration or other factors, excessively high stress from being applied to the first and second non-contact seals 16*a* and 17*a*. It is therefore possible to minimize the clearance between the rotor shaft 7 and the seals 16*a* and 17*a* to approximately 0.1 mm. Thus, the first non-contact seal 16*a* and the second non-contact seal 17*a* can exert their superior capabilities of sealing the shaft, to thereby block water from flowing through the first and second non-contact seals 16*a* and 17*a*.

Figure 4:
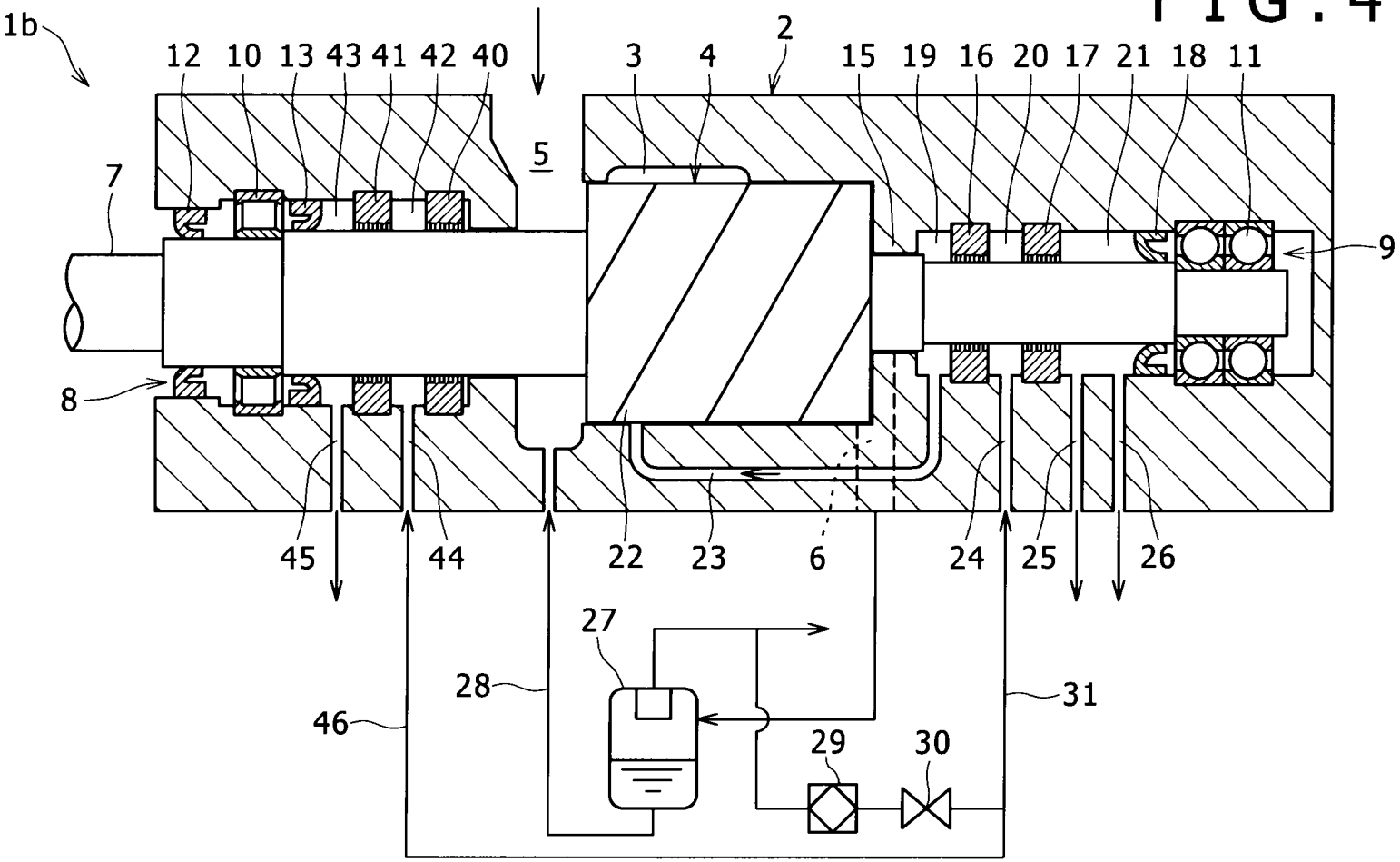
FIG. 4 is a simplified cross sectional diagram of a screw compressor according to a third embodiment of the present invention.

Next, a water injection type screw compressor 1*b* according to a third embodiment of this invention is shown in FIG. 4. In the water injection type screw compressor 1*b* of the third embodiment, a first non-contact seal 40 and a second non-contact seal 41 are disposed in sequence from the rotor chamber side between the rotor chamber 3 and the lip seal 13 for the rotor shaft 7 on the intake side (low pressure side), as in the case of the discharge side (high pressure side). Both the first non-contact seal 40 and the second non-contact seal 41 are also labyrinth seals having the structure similar to those of the first and second non-contact seals 16 and 17 on the high pressure side.

Thus, inside the shaft supporting and sealing space 8 on the low pressure side, a pressurized space 42 is formed between the first non-contact seal 40 and the second non-contact seal 41, while an open space 43 is formed between the second non-contact seal 41 and the lip seal 13. The casing 2 includes a pressurized communicating channel 44 for introducing the target gas at high pressure into the pressurized space 42 and an open communicating channel 45 that communicates with the open space 43 and the outside of the casing 2 so that the open space 43 opens to the atmosphere. The pressurized communicating channel 44 is connected to a pressurized pipe 46, which is branched from the pressurized pipe 31, located downstream of the regulator 30, so as to be provided with the target gas.

According to this embodiment, because the pressurized space 42, into which the target gas is introduced to thereby maintain the pressurized space 42 at high pressure, is additionally formed in the shaft supporting and sealing space 8 on the intake side, no target gas is allowed to enter the pressurized space 42 even when the pressure of the target gas sucked by the water injection type screw compressor 1*b*, i.e. the pressure of the intake channel 5 is higher than the atmospheric pressure. In this way, water entrained in the target gas is not allowed to enter and reach the lip seal 13, thereby preventing the lip seal 13 from getting damaged or preventing the lubricating oil for the bearings from leaking.

Figure 5:
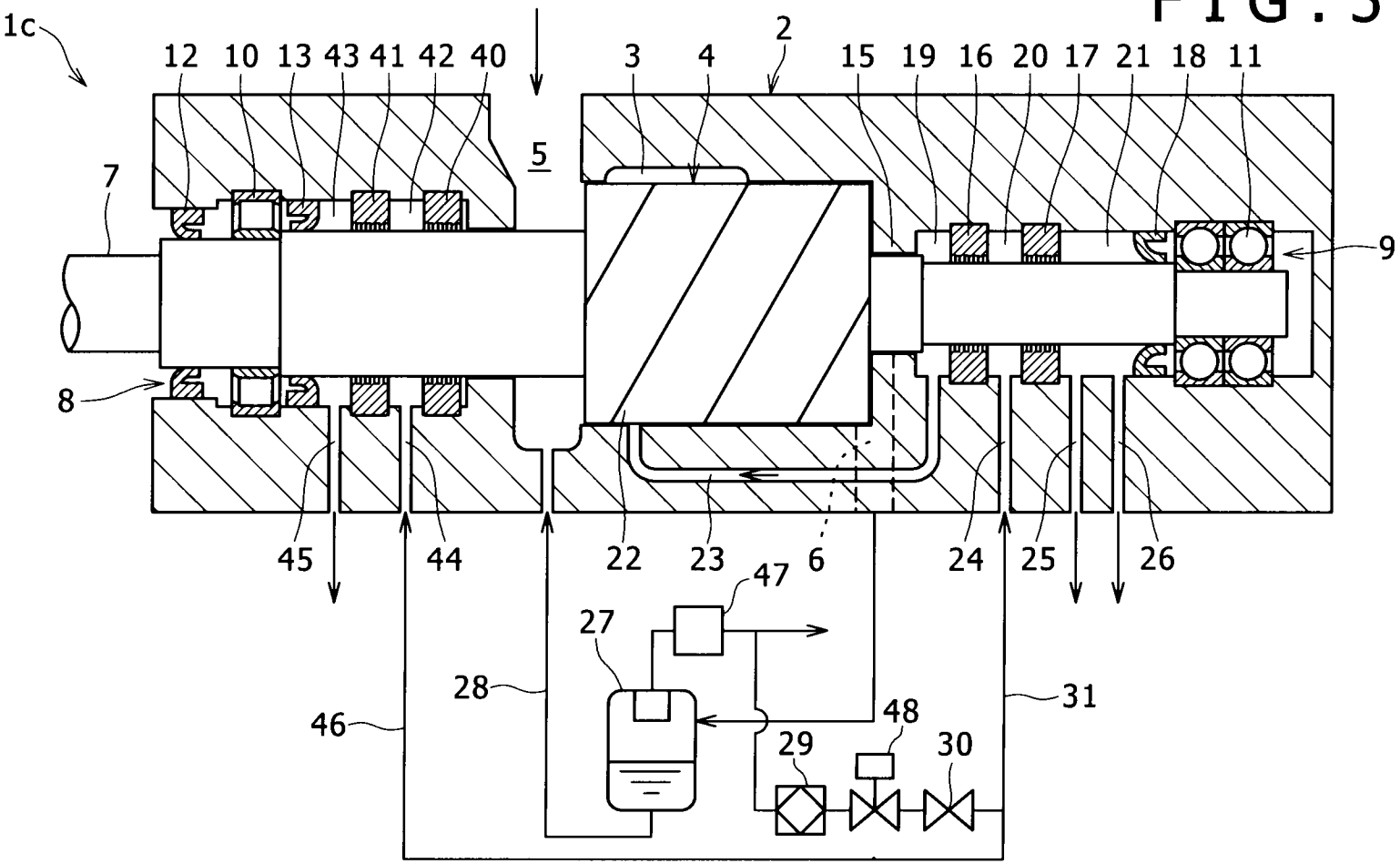
FIG. 5 is a simplified cross sectional diagram of a screw compressor according to a fourth embodiment of the present invention.

Further, a water injection type screw compressor 1*c* according to a fourth embodiment of this invention is shown in FIG. 5. The water injection type screw compressor 1*c* of this embodiment includes a dryer 47, which is disposed downstream of the water recovery unit 27 to supply the target gas dehumidified in the dryer 47 through the pressurized pipes 31, 46 and the pressurized communicating channels 24, 44 to the pressurized spaces 20, 42. Still further, an on-off valve 48 to be closed when the water injection type screw compressor 1*c* is stopped is installed in the pressurized pipe 31.

In the fourth embodiment, the dry target air, from which even moisture is removed by the dryer 48, is supplied to the pressurized spaces 20, 42, to thereby block moisture from penetrating into the open spaces 21, 43, to which the lip seals 18, 13 are exposed. Thus, the lip seals 18, 13 can be maintained in a completely dried condition.

Moreover, even in a situation of using a plurality of the water injection type screw compressors 1*c* of this embodiment connected in parallel, the target gas is not introduced into the pressurized space 20, 42 in a stopped water injection type screw compressors 1*c* from another water injection type screw compressors 1*c* because the on-off valve 48 is installed in each of the water injection type screw compressors 1*c*. This can eliminate wasteful consumption of the target gas, leading to high operation efficiency increased by controlling the number of the water injection type screw compressors 1*c*.

Preferably, the on-off valve 48 may be configured, to ensure its reliable operation, for example, as a single acting electromagnetic on-off valve of a normally closed type that the valve is opened only while power is being supplied. In addition, it is also preferable that a so-called pressure keeping check valve is inserted between the water recovery unit 27 and the dryer 47.

What is claimed is:

1. A water injection type screw fluid machine, in which a target gas is compressed or expansion force of the target gas is converted into turning force by intermeshing male and female screw rotors housed in a rotor chamber formed in a casing, while water is injected inside the rotor chamber to lubricate the screw rotors, the screw fluid machine comprising:

a first non-contact seal, a second non-contact seal, and a lip seal, which are disposed between the rotor chamber and a bearing for a rotor shaft of the screw rotor and in this order from the rotor chamber side;

a pressurized communicating channel for introducing the target gas which is at high pressure into a pressurized space formed between said first non-contact seal and said second non-contact seal; and an open communicating channel, through which an open space, which is formed between said second non-contact seal and said lip seal, opens to an outside of the casing.

2. The water injection type screw fluid machine according to claim 1, wherein:

the bearing is a bearing on the high pressure side, and the water injection type screw fluid machine further comprises a low pressure communicating channel for allowing an outflow space, which is formed on the rotor chamber side with respect to said first non-contact seal, to be communicated with a low pressure space inside the rotor chamber or a low pressure channel for the target gas, which is in communication with the rotor chamber.

3. The water injection type screw fluid machine according to claim 1, wherein:

the water injection type screw fluid machine is a water injection type screw compressor for compressing the target gas;

further comprises a water recovery unit for separating the water from the target gas that is discharged; and supplies the target gas, from which the water is separated in said water recovery unit, through a pressure reducing means to said pressurized communicating channel.

4. The water injection type screw fluid machine according to claim 3, supplies the target gas, from which the water is separated in said water recovery unit, through a dryer to said pressurized communicating channel.

5. The water injection type screw fluid machine according to claim 4, wherein an on-off valve, which is closed when operation of the water injection type screw fluid machine is stopped, is installed in said pressurized communicating channel or in a flow path between said water recovery unit and said pressurized communicating channel.

6. The water injection type screw fluid machine according to claim 1, further comprising a sleeve member fittingly mounted around the rotor shaft, said sleeve member located in said open space and equipped with a flange projected toward a radial outside.

7. The water injection type screw fluid machine according to claim 1, wherein each of said first and second non-contact seals includes: a fit member having opposed surfaces formed so as to be opposed to each other across an interval along an axial direction; two seal rings, which are respectively contacted with the opposed surfaces; and an elastic member disposed between said two seal rings to push said seal rings against the opposed surfaces.

* * * * *